US011988015B2

(12) United States Patent
Fischer

(10) Patent No.: US 11,988,015 B2
(45) Date of Patent: May 21, 2024

(54) SWIMMING POOL INTAKE FILTER COVER DEVICE

(71) Applicant: Douglas Fischer, Wetumpka, AL (US)

(72) Inventor: Douglas Fischer, Wetumpka, AL (US)

( * ) Notice: Subject to any disclaimer, the term of this patent is extended or adjusted under 35 U.S.C. 154(b) by 220 days.

(21) Appl. No.: 17/570,478

(22) Filed: Jan. 7, 2022

(65) Prior Publication Data

US 2023/0066733 A1 Mar. 2, 2023

Related U.S. Application Data

(60) Provisional application No. 63/240,093, filed on Sep. 2, 2021.

(51) Int. Cl.
*E04H 4/12* (2006.01)

(52) U.S. Cl.
CPC ..... *E04H 4/1254* (2013.01); *E04H 4/1272* (2013.01)

(58) Field of Classification Search
CPC ..... E04H 4/1254; E04H 4/1272
USPC ..... 210/167.19
See application file for complete search history.

(56) References Cited

U.S. PATENT DOCUMENTS 4,332,683 A * 6/1982 Alt ..... E04H 4/1254 210/499
5,935,450 A * 8/1999 Benedict ..... E04H 4/1272 210/776
6,989,093 B1 * 1/2006 Greathead ..... E04H 4/1254 210/232
7,594,997 B1 * 9/2009 Kazarian ..... E04H 4/1254 210/232
D619,773 S * 7/2010 Diermayer ..... D32/35
8,460,559 B2 * 6/2013 Conti ..... E04H 4/16 210/776
10,676,948 B1 * 6/2020 Nash, Sr. ..... E04H 4/1272
2005/0199538 A1 * 9/2005 Knapp ..... E04H 4/14 210/167.2
2014/0231324 A1 * 8/2014 Griffin ..... E04H 4/1272 210/167.19
2020/0070073 A1 * 3/2020 Strohbach ..... E04H 4/1272

* cited by examiner

*Primary Examiner* — Fred Prince

(74) *Attorney, Agent, or Firm* — Brennan, Manna & Diamond, LLC

(57) ABSTRACT

The present invention relates generally to a swimming pool intake filter cover device that is primarily comprised of a generally L-shaped body further comprised of at least one 90-degree elbow, at least one vertical frame member, at least one horizontal frame member, and at least one screen. The body of the device can be placed on a ground surface near a pool and a portion of the body can be placed within the pool in front of the intake filter opening of the skimmer. The portion of the body in front of the filter opening is further comprised of a screen that covers the front and sides of the opening, to prevent debris from entering into the opening. In differing embodiments, the body may be weighted to prevent movement of the body.

16 Claims, 4 Drawing Sheets

SWIMMING POOL INTAKE FILTER COVER DEVICE

CROSS-REFERENCE TO RELATED APPLICATION

The present application claims priority to, and the benefit of, U.S. Provisional Application No. 63/240,093 which was filed on Sep. 2, 2021 and is incorporated herein by reference in its entirety.

FIELD OF THE INVENTION

The present invention relates generally to the field of pools. More specifically, the present invention relates to a swimming pool intake filter cover device that is primarily comprised of a generally L-shaped body. The body of the device can be placed on a ground surface near a pool and a portion of the body can be placed within the pool in front of the intake filter opening of the skimmer. The portion of the body in front of the filter opening is further comprised of a screen that covers the front and sides of the opening to prevent debris from entering into the opening. Accordingly, the present disclosure makes specific reference thereto. Nonetheless, it is to be appreciated that aspects of the present invention are also equally applicable to other like applications, devices and methods of manufacture.

BACKGROUND

In-ground pools have a filtration system that includes a plurality of skimmers. A skimmer is a structure located at the top of a pool wall that has a generally rectangular filter intake opening. Water flows through the opening and through an intake filter basket into a main drain towards a pump and a main filter to be cleaned. However, debris can build up within the intake basket and opening, such that the pump becomes blocked. This in-turn may cause the pump to overheat, such that it needs replaced, which is extremely costly. To solve this problem, individuals may have to clear debris from the intake basket and opening multiple times a today. However, this is undesirable, as it is extremely burdensome and inefficient, especially if the user must wake in the middle of the night if the pool pump is required to be on.

Therefore, there exists a long-felt need in the art for a device that can be applied to an intake filter opening of a skimmer. There also exists a long-felt need in the art for a swimming pool intake filter cover device that prevents debris from entering into an intake filter opening of a skimmer and collecting within an intake filter basket. In addition, there exists a long-felt need in the art for a swimming pool intake filter cover device that prevents debris from entering into an intake filter opening and collecting within an intake filter basket, and thus does not require that a user continuously clean and monitor the intake filter basket or opening to ensure it is free of debris.

The subject matter disclosed and claimed herein, in one embodiment thereof, comprises a swimming pool intake filter cover device. The device is primarily comprised of a generally L-shaped body further comprised of at least one 90-degree elbow, at least one vertical frame member, at least one horizontal frame member, and at least one screen. The body of the device can be placed on a ground surface near a pool and a portion of the body can be placed within the pool in front of the intake filter opening of the skimmer. The portion of the body in front of the filter opening is further comprised of a screen that covers the front and sides of the opening to prevent debris from entering into the opening. In differing embodiments, the body may be weighted and can be further secured to a pool wall via at least one fastener to prevent movement of the body.

In this manner, the swimming pool intake filter cover device of the present invention accomplishes all of the forgoing objectives, and provides a swimming pool intake filter cover device that prevents debris from entering into an intake filter opening of a skimmer and collecting within an intake filter basket. Further, the swimming pool intake filter cover device accomplishes this without requiring that a user constantly check the device to clear debris. Therefore, the device prevents debris from clogging a pool pump which can otherwise cause the pump to overheat. In this manner, the swimming pool intake filter cover device overcomes the limitations of existing pool skimmers known in the art.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a swimming pool intake filter cover device. The device is preferably comprised of a generally L-shaped body further comprised of at least one 90-degree elbow, at least one vertical frame member, at least one horizontal frame member and at least one screen. The body of the device is preferably manufactured from a rigid, tubular plastic. In differing embodiments, the body may be hollow, partially hollow or solid. The preferred embodiment of the body is comprised of approximately six 90-degree elbows that are attached to two horizontal frame members and four vertical frame members, which form a generally L-shaped body.

The device can be positioned near a pool, such that a horizontal frame member rests on a ground surface adjacent to the pool, and a vertical frame member rests against the vertical side wall of a pool, with the two elbows resting on a corner of the pool. The vertical frame members connect the horizontal members, which are connected to the elbows. In order to ensure the device remains in position while resting on the ground surface, an embodiment of the device with a hollow body may feature at least one cap that can be removed, such that the hollow body can be filled with sand or another weighted substance. The body may also be comprised of at least one fixedly or removably-attached weight, that attaches to any portion of the body that rests on the ground surface. Wherein, the weight attaches to the elbow, horizontal frame member, and/or vertical frame members via at least one fastener. In either embodiment, the added weight prevents the movement of the body, to ensure the device remains in the desired position in front of an intake filter opening.

Similarly, the elbows, vertical frame members, and/or the horizontal frame member that rests against the side wall of a pool may be comprised of at least one fastener that attaches to the pool wall, and prevents movement from the portion of the body that rests against the pool wall. Thus, the at least one fastener ensures that the device remains in the desired position in front of an intake filter opening. The elbows, vertical frame members, and/or the horizontal frame members that rest against the pool wall are further comprised of a mesh screen or netting that attaches via at least one fastener. The screen further wraps around the elbows, vertical frame members, and/or the horizontal frame members, such that no debris can enter the intake filter opening of a skimmer from the front or from the side of the opening.

In a differing embodiment, the body has a top panel with two pairs of generally parallel side surfaces that may attach to and/or cover the elbows, vertical frame members, and/or horizontal frame members that rest on the ground surface. The panel preferably conceals the elbows, vertical frame members, and/or horizontal frame members from view, and may have a plurality of appearances, colors, and textures that may mimic the ground surface, (i.e., concrete, stamped concrete, brick, grass, etc.). The top panel preferably attaches to the elbows, vertical frame members, and/or horizontal frame members via at least one fastener.

Accordingly, the swimming pool intake filter cover device of the present invention is particularly advantageous as it prevents debris from entering into an intake filter opening of a skimmer and collecting within an intake filter basket. Further, the swimming pool intake filter cover device accomplishes this without requiring that a user constantly check the device to clear debris. Therefore, the device prevents debris from clogging a pool pump, which would otherwise cause the pump to overheat. In this manner, the swimming pool intake filter cover device overcomes the limitations of existing pool skimmers known in the art.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
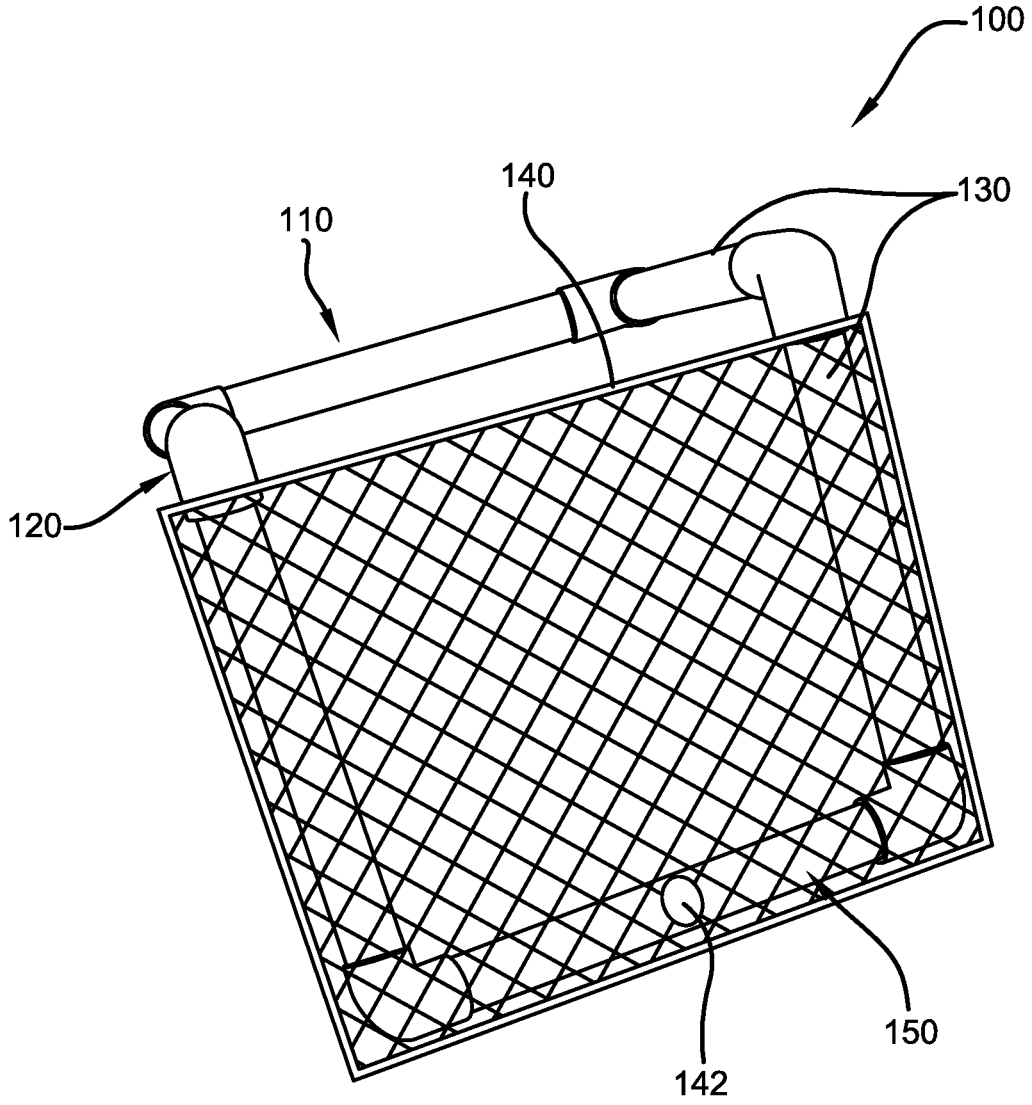
FIG. 1 illustrates a perspective view of one embodiment of the swimming pool intake filter cover device of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long-felt need in the art for a device that can be applied to an intake filter opening of a skimmer. There also exists a long-felt need in the art for a swimming pool intake filter cover device, that prevents debris from entering into an intake filter opening of a skimmer and collecting within an intake filter basket. In addition, there exists a long-felt need in the art for a swimming pool intake filter cover device that prevents debris from entering into an intake filter opening and collecting within an intake filter basket, and that does not require that a user continuously clean and monitor the intake filter basket or opening to ensure it is free of debris.

The present invention, in one exemplary embodiment, is comprised of a swimming pool intake filter cover device primarily comprised of a generally L-shaped body, further comprised of at least one 90-degree elbow, at least one vertical frame member, at least one horizontal frame member, and at least one screen. The body of the device is preferably manufactured from a rigid, tubular plastic. In differing embodiments, the body may be hollow, partially hollow or solid. The preferred embodiment of the body is comprised of approximately six 90-degree elbows, that are attached to two horizontal frame members and four vertical frame members, which form a generally L-shaped body.

During use, the device can be positioned near a pool, such that a horizontal frame member rests on a ground surface adjacent to the pool, and a vertical frame member rests against the vertical side wall of a pool with the two elbows resting on a corner of the pool. The vertical frame members further connect the horizontal members, which are connected to the elbows. To ensure the device remains in position while resting on the ground surface, an embodiment of the device with a hollow body may feature at least one removable cap that can be removed, such that the hollow body can be filled with sand or another weighted substance. The body may also be comprised of at least one fixedly or removably-attached weight, that attaches to any portion of the body that rests on the ground surface. Wherein the weight attaches to the elbow, horizontal frame member, and/or vertical frame member via at least one fastener. As a result, the added weight prevents the movement of the body, in order to ensure the device remains in the desired position in front of an intake filter opening.

Similarly, the elbows, vertical frame members, and/or the horizontal frame members that rest against the side wall of a pool may be comprised of at least one fastener that attaches to the pool wall and prevents movement from the portion of the body that rests against the pool wall. Therefore, the device remains in the desired position in front of an intake filter opening. The elbows, vertical frame members, and/or the horizontal frame members that rest against the pool wall are further comprised of a mesh screen or netting, that attaches via at least one fastener. The screen further wraps around the elbows, vertical frame members, and/or the horizontal frame members, such that no debris can enter the intake filter opening of a pool from the front of or the side of the opening.

In a differing embodiment, the body has a top panel with two pairs of generally parallel side surfaces, that may attach to and/or cover the elbows, vertical frame members, and/or horizontal frame members that rest on the ground surface. The panel preferably conceals the elbows, vertical frame members, and/or horizontal frame members from view and may have a plurality of appearances, colors and textures, that may mimic the ground surface, (i.e., concrete, stamped concrete, brick, grass, etc.). The top panel preferably attaches to the elbows, vertical frame members and/or horizontal frame members via at least one fastener.

Accordingly, the swimming pool intake filter cover device of the present invention is particularly advantageous, as it prevents debris from entering into an intake filter opening of a skimmer and collecting within an intake filter basket. Further, the swimming pool intake filter cover device accomplishes this without requiring that a user constantly check the device to clear debris. Therefore, the device prevents debris from clogging a pool pump, which can cause the pump to overheat. In this manner, the swimming pool intake filter cover device overcomes the limitations of existing pool skimmers known in the art.

Referring initially to the drawings, FIG. 1 illustrates a perspective view of one embodiment of a swimming pool intake filter cover device 100 of the present invention. The device 100 is preferably comprised of a generally L-shaped body 110, further comprised of at least one approximately 90-degree elbow 120, at least one vertical frame member 130, at least one horizontal frame member 150, and at least one screen 140. In the preferred embodiment, the body 110 is manufactured from a rigid plastic such as, but not limited to, acrylic, polycarbonate, polyethylene, thermoplastic, acrylonitrile butadiene styrene, low density polyethylene, medium density polyethylene, high density polyethylene, polyethylene terephthalate, polyvinyl chloride, polystyrene, polylactic acid, acetal, nylon, fiberglass, recycled plastic, biodegradable plastic, etc., or any other suitable material as is known in the art. Although, in differing embodiments, the body 110 may be manufactured from a durable metal, such as, but not limited to, stainless steel or aluminum, or any other suitable metal as is known in the art.

Further, the elbows 120, vertical members 130 and horizontal members 150 are all preferably tubular and hollow, but in differing embodiments may be cylindrical, square, triangular, oblong, etc., or any other suitable shape as is known in the art, and may be partially hollow or solid depending on the wants and/or needs of a user. In addition, the body 110 may be any suitable color as is known in the art, and may be opaque, transparent or semi-transparent, depending on the wants and/or needs of a user. In addition, the elbows 120, vertical members 130, and horizontal members 150 may have a plurality of indicia 174 (shown in FIG. 4) such as, but not limited to, patterns, logos, emblems, images, symbols, designs, letters, words, characters, animals, advertisements, brands, etc., or any other suitable indicia as is known in the art.

In the preferred embodiment, the body 110 is comprised of approximately six 90-degree elbows 120 that are attached to two horizontal frame members 150 and four vertical frame members 130, which form a generally L-shaped body once assembled. However, the number of elbows 120, vertical members 130 and horizontal members 150 may differ in various embodiments depending on the wants and/or needs of a user. Furthermore, in one embodiment, the elbows 120, vertical members 130 and horizontal members 150, may be securely connected, (i.e., molded or glued together). In a differing embodiment, the elbows 120, vertical members 130, and horizontal members 150 may be removably attached to one another, (i.e., via screws or pins).

Additionally, the elbows 120, vertical frame members 130, and/or the horizontal frame members 150 that rest against the pool wall are further comprised of at least one mesh screen 140 or netting, or any other suitable screened material as is known in the art, that attaches to the elbows 120, vertical frame members 130, and/or the horizontal frame members 150 via at least one fastener 142. The at least one fastener 142 can be any suitable fastener as is known in the art such as, but not limited to, a hook and loop fastener, a magnet, an adhesive, a button and loop fastener, a bolt, a screw, etc. The screen 140 further wraps around the elbows 120, vertical frame members 130, and/or the horizontal frame members 150, such that no debris can enter the intake filter opening of the pool from the area in front of or to the side of the opening. The screen 140 can be a typical window screen or a vinyl screen, wherein the vinyl is melted onto the frame members.

Figure 2:
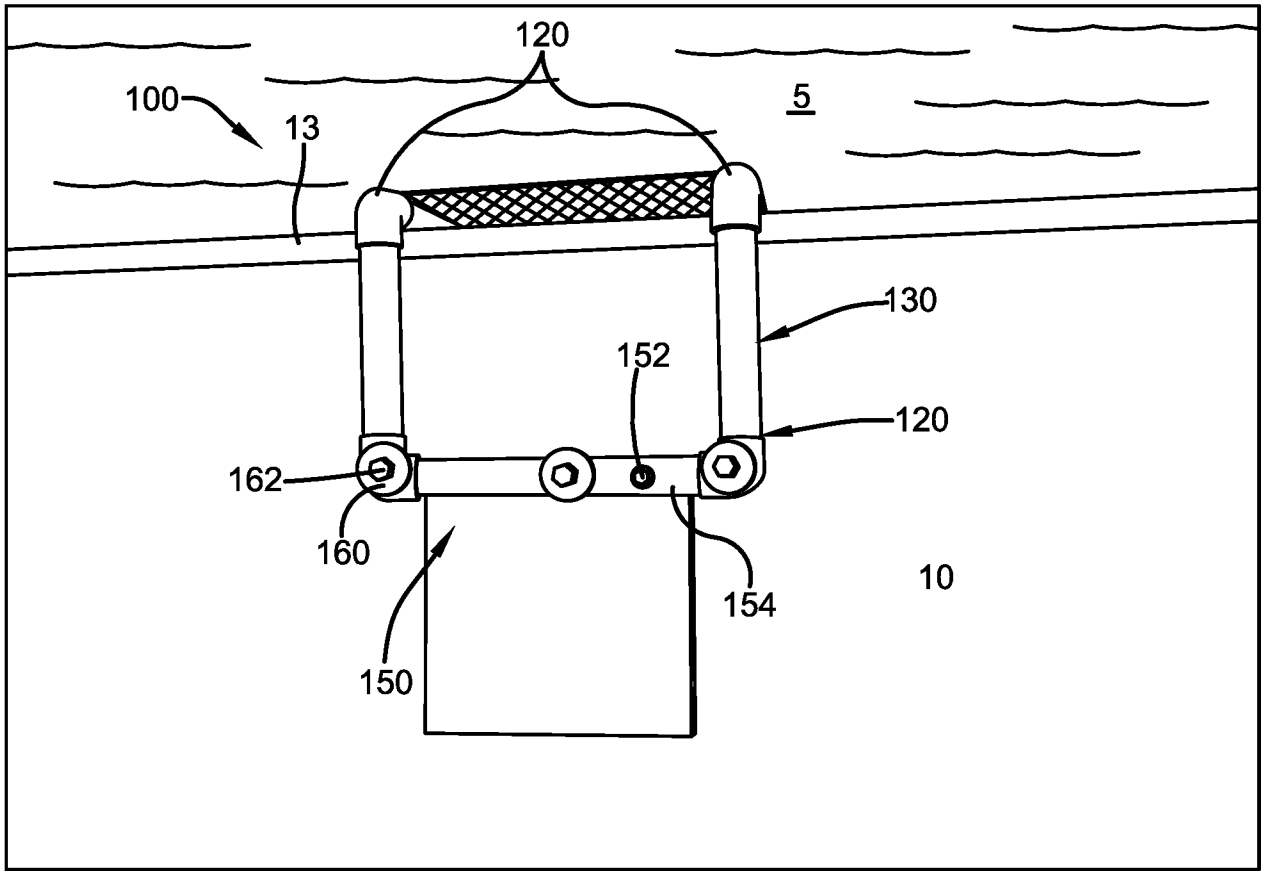
FIG. 2 illustrates a top view of one embodiment of the swimming pool intake filter cover device of the present invention while positioned over a pool intake filter opening in accordance with the disclosed architecture.

FIG. 2 illustrates a top view of one embodiment of the swimming pool intake filter cover device 100 of the present invention while positioned over a pool intake filter opening 12. As stated supra, once assembled the body 110 forms a generally L-like shape. As such, the device 100 can be positioned near a pool 5, such that a horizontal frame member 150 rests on a ground surface 10 adjacent to the pool 5, and another horizontal frame member 150 (shown in FIG. 3) rests against the vertical side wall 11 of a pool 5, and two of the elbows 120 rest on a corner 13 of the pool 5. The vertical frame members 130 then serve to connect the horizontal members 150 via additional elbows 120.

Further, to ensure the device 100 remains in position while resting on the ground surface 10, an embodiment of the device 100 comprises a hollow body 110 which contains at least one removable cap 152, (i.e., that may be threaded or non-threaded), and that is preferably located on the outer surface 154 of the horizontal frame member 150 (but may also be located on an elbow 120 and/or vertical frame member 130) that rests on the ground surface 10. Accordingly, the cap 152 can be removed, such that the hollow body 110 can be filled with sand or any other suitable weighted substance, and then replaced when the body 110 has been filled to the desired weight.

In an additional embodiment, the device 100 may be comprised of at least one fixedly or removably-attached weight 160, that attaches to any portion of the body 110 that rests on the ground surface 10. Typically, the weight 160 attaches to the elbow 120, horizontal frame member 150 and/or vertical frame members 130 via at least one fastener 162 such as, but not limited to, a hook and loop fastener, a magnet, an adhesive, a button and loop fastener, a bolt, a screw, etc., or any other suitable fastener as is known in the art.

In either embodiment, the added weight prevents movement of the body 110 in order to ensure the device 100 remains in the desired position in front of an intake filter opening 12. Similarly, the elbows 120, vertical frame members 130, and/or the horizontal frame member 150 that rest against the side wall 11 of a pool 5 may be comprised of at least one fastener 162 such as, but not limited to, a hook and loop fastener, a magnet, an adhesive, a button and loop fastener, a bolt, a screw, a suction cup etc., or any other suitable fastener that attaches to the pool wall 11 and prevents movement from the portion of the body 110 that rests against the pool wall 11, in order to ensure the device 100 remains in the desired position in front of an intake filter opening 12.

Figure 3:
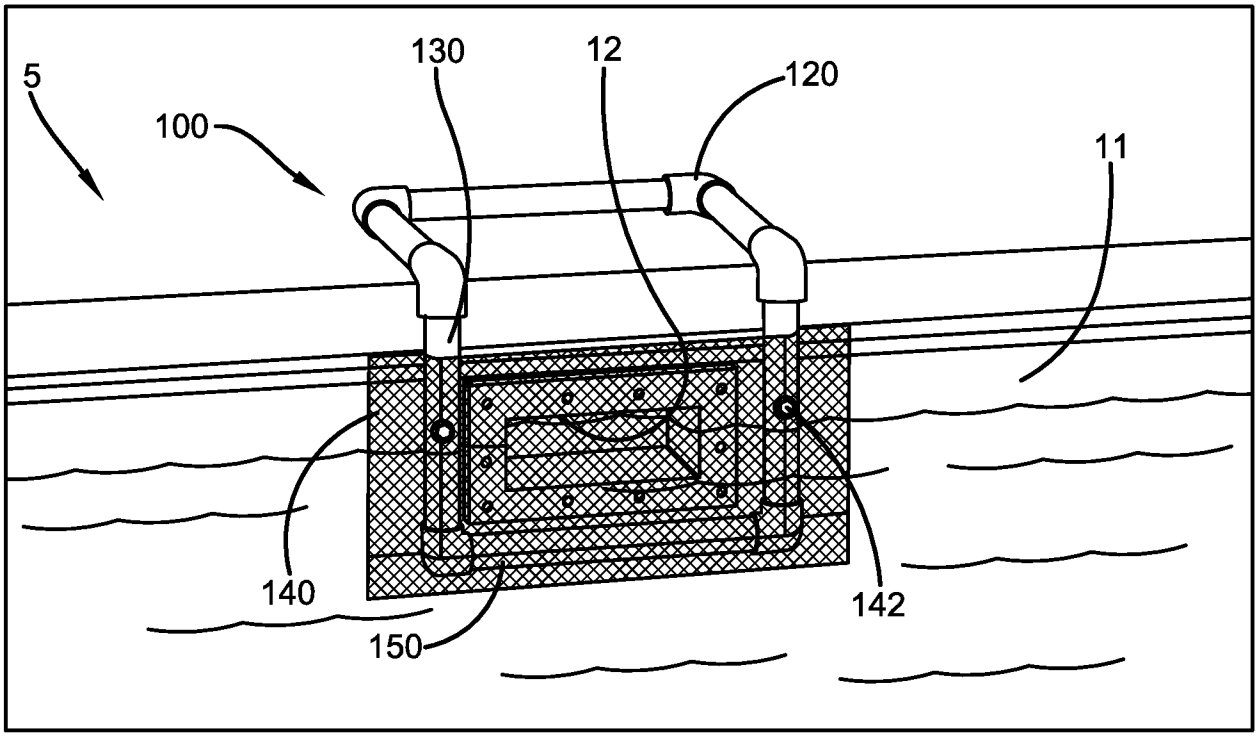
FIG. 3 illustrates a front perspective view of one embodiment of the swimming pool intake filter cover device of the present invention while positioned over a pool intake filter opening in accordance with the disclosed architecture.

FIG. 3 illustrates a front perspective view of one embodiment of the swimming pool intake filter cover device 100 of the present invention while positioned over a pool intake filter opening. The elbows 120, vertical frame members 130, and/or the horizontal frame members 150 that rest against the pool wall 11 are further comprised of at least one mesh screen 140 or netting material, etc., or any other suitable screening material as is known in the art, that attaches to the elbows 120, vertical frame members 130, and/or the horizontal frame members 150 via at least one fastener 142. The at least one fastener 142 comprises any suitable fastener as is known in the art such as, but not limited to, a hook and loop fastener, a magnet, an adhesive, a button and loop fastener, a bolt, a screw, etc. The screen 140 further wraps around the elbows 120, vertical frame members 130, and/or the horizontal frame members 150, such that no debris can enter the intake filter opening 12 of a pool 5 from the area in front of or to the side of the opening 12.

Figure 4:
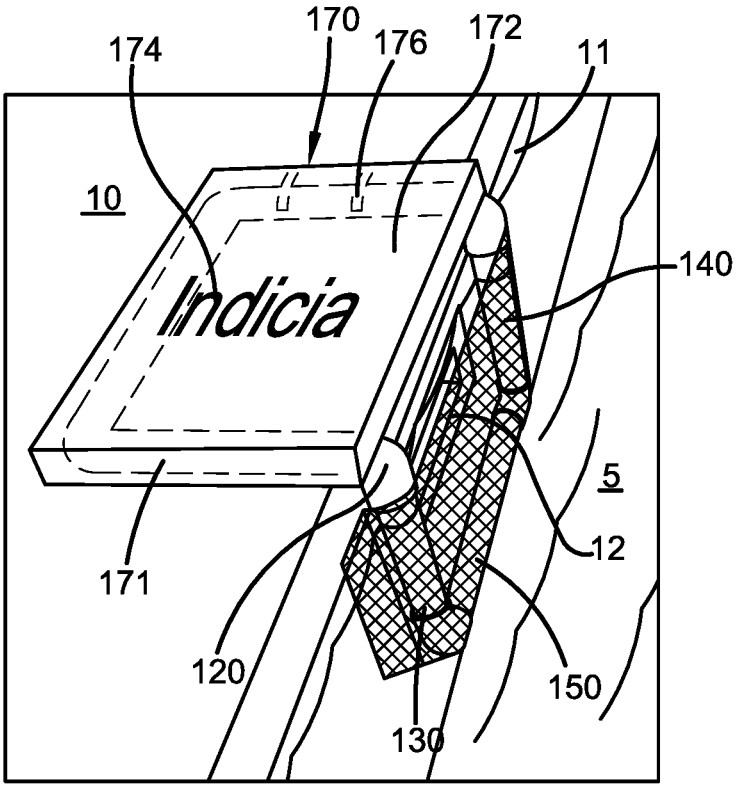
FIG. 4 illustrates a perspective view of one embodiment of the swimming pool intake filter cover device of the present invention shown with a top panel in accordance with the disclosed architecture.

FIG. 4 illustrates a perspective view of one embodiment of the swimming pool intake filter cover device 100 of the present invention with a top panel. In an additional embodiment, the body 110 is comprised of a top panel 170 with two pairs of generally parallel side surfaces 171 that may attach to and/or cover the elbows 120, vertical frame members 130, and/or horizontal frame members 150 that rest on the ground surface. The panel 170 preferably conceals the elbows 120, vertical frame members 130 and/or horizontal frame members 150 from view. The panel 170 may also have a plurality of appearances, colors, and textures that may mimic the ground surface 10 next to a pool 5, (i.e., concrete, stamped concrete, brick, grass, etc.). The top surface 172 of the panel 170 may further have a plurality of indicia 174, such as patterns, logos, emblems, images, symbols, designs, letters, words, characters, animals, advertisements, brands, etc., or any other suitable indicia as is known in the art.

Further, the top panel 170 preferably attaches to the elbows 120, vertical frame members 130, and/or horizontal frame members 150 via at least one fastener 176 such as, but not limited to, a hook and loop fastener, a magnet, an adhesive, a button and loop fastener, a bolt, a screw, etc., or any other suitable fastener as is known in the art. In an additional embodiment, the top panel 170 may be integrally formed to the body 110 as one part, or the entire device can be integrally.

Furthermore, the elbows 120, vertical frame members 130, and/or the horizontal frame members 150 that rest against the pool wall 11 are further comprised of at least one mesh screen 140. The screen 140 wraps around the elbows 120, vertical frame members 130, and/or the horizontal frame members 150, such that no debris can enter the intake filter opening 12 of a pool 5 from the area in front of or to the side of the opening 12.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "swimming pool intake filter cover device" and "device" are interchangeable and refer to the swimming pool intake filter cover device 100 of the present invention.

Notwithstanding the forgoing, the swimming pool intake filter cover device 100 of the present invention and its various components can be of any suitable size and configuration as is known in the art without affecting the overall concept of the invention, provided that they accomplish the above-stated objectives. One of ordinary skill in the art will appreciate that the size, configuration and material of the swimming pool intake filter cover device 100 as shown in FIGS. 1-4 is for illustrative purposes only, and that many other sizes and shapes of the swimming pool intake filter cover device 100 are well within the scope of the present disclosure. Although the dimensions of the swimming pool intake filter cover device 100 are important design parameters for user convenience, the swimming pool intake filter cover device 100 may be of any size, shape and/or configuration that ensures optimal performance during use, and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A swimming pool intake filter cover device comprising:
a generally L-shaped body further comprised of:
at least one 90-degree elbow;
at least one vertical frame member;
at least one horizontal frame member;
at least one screen; and
at least one indicia on the at least one 90-degree elbow, the at least one vertical frame member, or the at least one horizontal frame member; and
wherein the at least one screen is a vinyl mesh screen that is melted onto the at least one vertical frame member, or the at least one horizontal frame member.

2. The swimming pool intake filter cover device of claim 1, wherein the swimming pool intake filter cover device can be placed on a ground surface adjacent to a pool and in front of an intake filter opening of a skimmer in a side wall of the pool.

3. The swimming pool intake filter cover device of claim 2, wherein the at least one screen wraps around the at least one 90-degree elbow, the at least one vertical frame member, or the at least one horizontal frame member and prevents debris from entering into the intake filter opening of the skimmer.

4. A swimming pool intake filter cover device comprising:
a generally L-shaped body further comprised of:
at least one 90-degree elbow;
at least one vertical frame member;
at least one horizontal frame member;
at least one screen magnetically attached to the at least one vertical frame member, the at least one horizontal frame member, or the at least one 90-degree elbow via at least one fastener; and
at least one weight removably attachable to the at least one horizontal frame member; and
wherein the at least one vertical frame member comprises a fastener configured to secure the at least one vertical frame member to a pool sidewall.

5. The swimming pool intake filter cover device of claim 4, wherein the swimming pool intake filter cover device can be placed on a ground surface adjacent a pool and in front of an intake filter opening of a skimmer in a side wall of the pool.

6. The swimming pool intake filter cover device of claim 4, wherein the at least one screen wraps around the at least one 90-degree elbow, the at least one vertical frame member, or the at least one horizontal frame member and prevents debris from entering into the intake filter opening of the skimmer.

7. The swimming pool intake filter cover device of claim 4, wherein the at least one vertical frame member, the at least one horizontal frame member, or the at least one 90-degree elbow are hollow.

8. The swimming pool intake filter cover device of claim 7, wherein the hollow at least one vertical frame member, the at least one horizontal frame member, or the at least one 90-degree elbow are filled with sand.

9. The swimming pool intake filter cover device of claim 8, wherein the at least one vertical frame member, the at least one horizontal frame member, or the at least one 90-degree elbow are securely connected to one another via glue.

10. A swimming pool intake filter cover device that can be positioned in front of an intake filter opening of a skimmer in a pool, the swimming pool intake filter cover device comprising:
a generally L-shaped body further comprised of:
at least one 90-degree elbow;
at least one vertical frame member;
at least one horizontal frame member;
at least one screen attached to the at least one vertical frame member, the at least one horizontal frame member, or the at least one 90-degree elbow via at least one fastener that prevents debris from entering an intake filter opening; and
a top panel comprising a top surface and a first pair and a second pair of generally parallel side surfaces, wherein the top panel is configured to attach to and cover a portion of the L-shaped body that rests on a ground surface and to mimic the ground surface.

11. The swimming pool intake filter cover device of claim 10, wherein the swimming pool intake filter cover device can be positioned adjacent a pool, such that the at least one horizontal frame member rests on a ground surface adjacent to the pool and another horizontal frame member rests against a vertical side wall of a pool, and the at least one elbow rests on a corner of the pool.

12. The swimming pool intake filter cover device of claim 11, wherein the top panel attaches to the at least one vertical frame member, the at least one horizontal frame member, and the at least one 90-degree elbow via at least one fastener.

13. The swimming pool intake filter cover device of claim 12, wherein the at least one fastener is a hook and loop fastener, a magnet, an adhesive, a button and loop fastener, a bolt, or a screw.

14. The swimming pool intake filter cover device of claim 10, wherein the at least one vertical frame member, the at least one horizontal frame member, or the at least one 90-degree elbow are hollow.

15. The swimming pool intake filter cover device of claim 14, wherein the hollow at least one vertical frame member, the at least one horizontal frame member, or the at least one 90-degree elbow are filled with sand.

16. The swimming pool intake filter cover device of claim 15, wherein the at least one vertical frame member, the at least one horizontal frame member, or the at least one 90-degree elbow are securely connected to one another via glue.

* * * * *